US005360260A

United States Patent [19]

Baumann et al.

[11] Patent Number: 5,360,260

[45] Date of Patent: Nov. 1, 1994

[54] TUNNELING MACHINE WITH RADIALLY SWEEPING TOOL CARRIERS

[75] Inventors: Lothar E. Baumann, Velbert; Hans G. Kappelmann, Mülheim/Ruhr; Volkmar Mertens, Essen; Bernhard T. Schafeld, Bottrop; Werner W. Vorhoff, Wesel; Heinz Wallussek, Herdecke, all of Germany

[73] Assignee: Bergwerksverband BmbH, Essen, Germany

[21] Appl. No.: 64,079

[22] PCT Filed: Dec. 6, 1991

[86] PCT No.: PCT/EP91/02345

§ 371 Date: May 19, 1993

§ 102(e) Date: May 19, 1993

[87] PCT Pub. No.: WO92/10647

PCT Pub. Date: Jun. 25, 1992

[30] Foreign Application Priority Data

Dec. 12, 1990 [DE] Germany ..... 4039646

[51] Int. Cl.[5] ..... F21B 10/04; E21D 9/10

[52] U.S. Cl. ..... 299/59; 175/404; 299/31

[58] Field of Search ..... 299/55, 59, 60, 61, 299/85, 90, 31; 175/403, 404

[56] References Cited

U.S. PATENT DOCUMENTS 2,741,462 4/1956 Baca ..... 175/404

FOREIGN PATENT DOCUMENTS 1351000 12/1963 France ..... 299/59
1002775 2/1957 Germany .
1247988 8/1967 Germany .
3140707 4/1983 Germany .
3940489 4/1991 Germany .
18185 11/1991 WIPO .

*Primary Examiner*—David J. Bagnell
*Attorney, Agent, or Firm*—John W. Carpenter

[57] ABSTRACT

In order to drift underground roads, tunnelling machines are used that have a rotatively driven boring head base body, a rigid first bit and rail heads that can radially sweep around axes of rotation between the working point in a conductor shaft and gallery faces by means of thrusting piston gears that carry at least one roller boring tool. In order to improve the coordination between an opening of the conductor shaft and under cutting, which are carried out simultaneously, a first bit. (2) is designed as a ring borer (2) that breaks out a drilling core (3) through slits of an annular cavity (4). The ring borer (2) has two parallel arms (6) spaced apart from a central axis (5) that carry boring tools (7) articulated on a cross-beam (10) of a carrying frame (9) that has an advancing device (11). The carrying frame (9) surrounds the thrusting piston gears (18) for radially sweeping rail heads (12), and perpendicularly arranged to the rail heads (12) and extends parallel to the central axis (5) at the boring head base body (1).

5 Claims, 1 Drawing Sheet

TUNNELING MACHINE WITH RADIALLY SWEEPING TOOL CARRIERS

The invention concerns a tunneling machine for application underground with a rotatively driven boring head base body, which is equipped with a fixed pilot borer and tool-bearing tool carriers that sweep radially by means of feed-piston gear units around axis of rotation between the point of application in the pilot hole and the gallery sides and that carry at least one roller boring tool.

DE-PS 31 40 707 presents a typical tunneling machine, in which the pilot borer, is coupled with a central driveshaft connected to the boring head base body. This driveshaft, on the one hand, limits the sweep angle of the tool-bearing tool carriers that sweep radially between the point of application in the pilot hole and the gallery sides, and on the other hand, has to transmit very large forces in connection with a pilot borer of large diameter.

The pilot borer has to have a diameter large enough so that in order to realize the advantage of undercutting, the roller tools of the sweepable tool bearer can, between the driveshaft and the borehole wall, effectively engage the rock face. A pilot boring head of that size necessitates the transmission of very high torque values and requires very high forces of application, resulting in highly inefficient energy consumption.

Moreover, the driveshaft must be able to withstand the shearing forces resulting from the large pilot boring head. In the implementation of a rigid shaft, one which carries the pilot borer, there arise further complications in construction in that it is difficult to find a place to locate the feed-piston gear units required for the sweepable tool-holding tool arms.

Deviating from such a style of tunneling machine, the unpublished patent application P40 15 462.9 presents another machine for cutting underground passages with a rotatively driven boring head, to which, for example, four sweepable tool arms holding roller boring tools are articulated. Since an arrangement of this type works without a pilot hole, and since at the same time, however, the roller boring tools are to work in accordance with the undercutting principle, a tool arm is provided which is pivotable, being nearly centrally articulated to the working head, in order to provide a suitable cavity for the engagement of the remaining tool carriers.

In the process very high forces occur for a single tool arm jointed eccentrically to the working head, which is to achieve the effect of a pilot borer. Such high forces cause considerable wear and tear. Furthermore, an essential disadvantage arises in such an arrangement in that a continuous operation, that is, a simultaneous hollowing out for undercutting and the undercutting proper cannot be accomplished.

Incumbent upon the invention is the task of developing a tunneling machine which on the basis of the simultaneity of the pilot boring and undercutting procedures avoids the aforementioned disadvantages, especially regarding the occurring torque values and shear forces. Such a tunneling machine should require only minimal forces of application vis-a-vis the surface to be worked by the pilot borer and thus conserve considerable energy and avoid the previous wear and tear through improvement in construction.

According to the invention, the problem is resolved in that the pilot borer is constructed as a ring borer that breaks out a drilling core through slits of an annular cavity, which consists of two parallel, boring-tool-carrying tool arms spaced apart from a central axis and articulated on a crossbeam of a support frame incorporating an advancing mechanism. In this arrangement the support frame surrounds the feed-piston gear units for the radially sweepable tool carriers. The support frame is positioned perpendicular to the tool carriers and extends parallel to the central axis at the boring base body.

The frame construction arranged at right angles to the sweepable tool carriers at the boring head base body allows the possibility of creating sufficient space for the feed-piston gear units of the sweepable tool carriers.

Beyond that, the possibility exists through the formation of the pilot borer as a ring borer, specifically by means of two tool arms articulated to a crossbeam, to focus the boring on a ringlike cavity, which requires less torque and less force of application, due to the smaller surface to be worked. Furthermore, the right-angle arrangement of the frame construction and the tool arms articulated to it which constitute the pilot borer, permits an enlargement of the angle of sweep for the tool carriers working on the undercutting principle.

Since the sweepable tool carriers, each equipped with at least one roller boring tool, can, in their arrangement at right angles to the support frame, engage the rock face in the space between the tool arms that constitute the ring borer, they are at the same time in position to destroy the drilling core on their return path, in the event that it doesn't break off on its own. The frame construction that supports the ring borer can be reinforced with additional crossbracing, and can in this way absorb without difficulty the forces appearing at the ring borer.

The forward-feed cylinders are at the same time integrated into the side members of the support frame, so that the forward feed of the ring borer is independent of the forward movement of the tunneling machine. The control mechanism of the pilot borer or the forward-feed arrangement is independent of the control mechanism of the sweep arms.

The tool arms that make up the ring borer can be provided with rollerboring tools or hardened steel chisels jointed to exchangeable tool holders.

An example of the operation of the invention is represented in the drawings and is explained in more detail in what follows.

FIGS. 1 and 2 show only the front portion, that is, the rotatable boring head base body (1) of a tunneling machine, in which by means of swivel axes (14) two tool carriers (12) holding two roller boring tools (13) are jointed in a way that they can pivot radially from inside to outside of the gallery faces.

Figure 2:
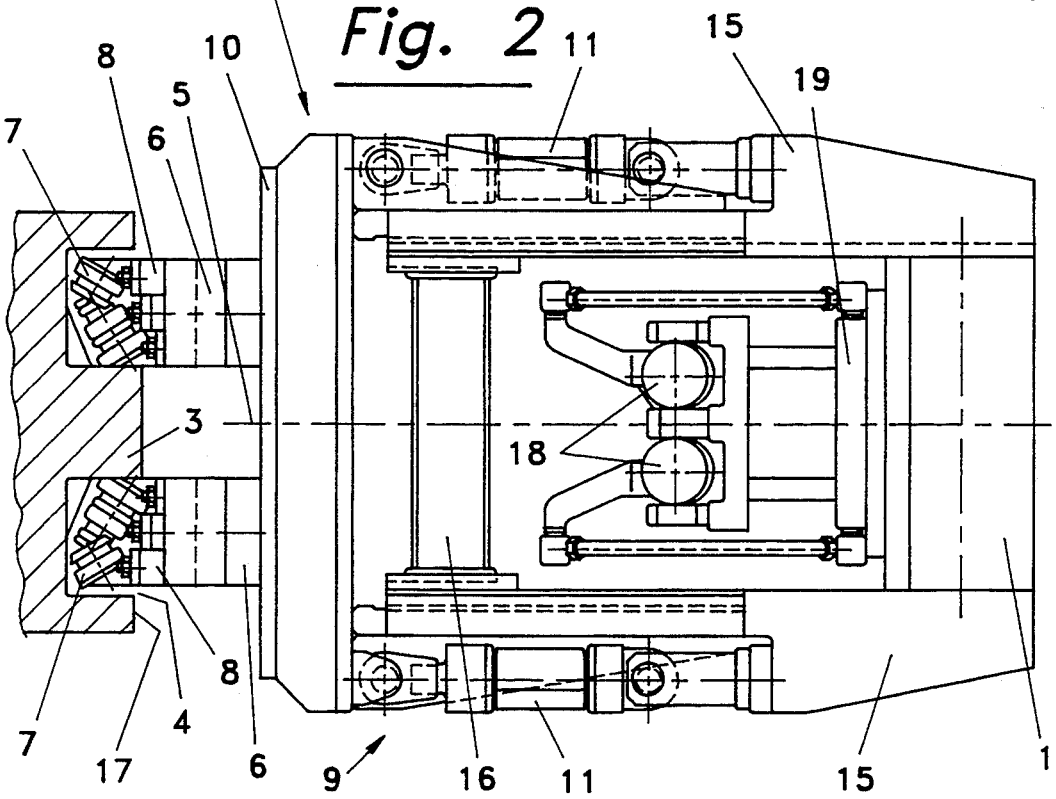

As FIG. 2 illustrates, a frame construction (9) is articulated at the boring head base body (1) between the tool carriers (12) in a manner parallel to a central axis (5) and at right angles to the tool carriers (12).

The frame construction (9) consists of side members (15) which are connected to each other by means of a crossbeam (10), as illustrated in FIG. 2. The forward-feed mechanism is integrated into the side members (15) in the form of one forward-feed cylinder (11) per each side member.

The frame-like support structure (9) is strengthened in the depicted example by means of a crossbrace (16). The support frame surrounds the forward-feed piston gear units (18), which are anchored in a mounting support (19), and by means of which the sweepable tool carriers (12) are radially moveable.

Figure 1:
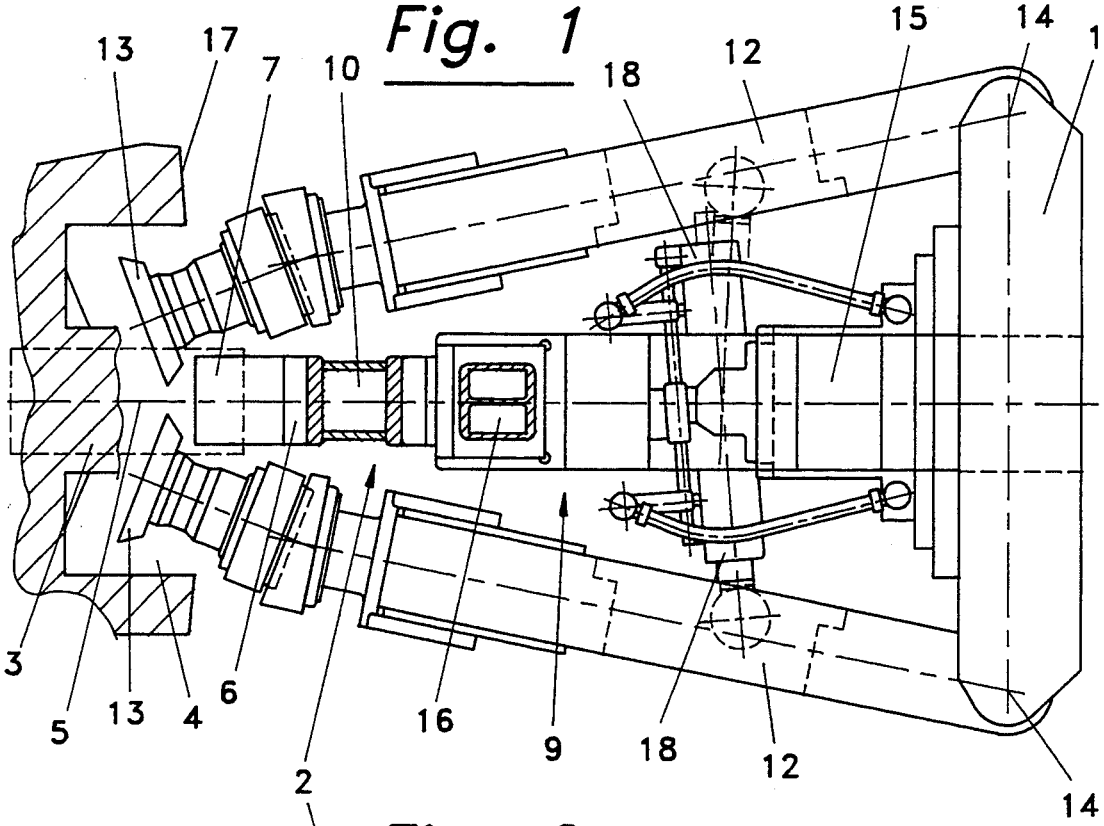
FIG. 1 shows the top view of an operational example of a partially represented tunneling machine and FIG. 2 shows the top view of the example in FIG. 1 turned by 90°.

The pilot borer (2) is situated at the crossbeam (10) of the support frame (9) in the form of a ring borer. As is seen in FIGS. 1 and 2, the ring borer consists of two tool arms (6) spaced apart from a central axis (5) articulated on the crossbeam and equipped with boring tools (7). The tool arms (6) have replaceable tool holders (8) which can be provided with roller boring tools (7) or hardened steel chisels. By means of the rotary motion of the boring head base body around its axis (5), a ring-like cavity (4) is formed at the boring site (17) by the tool arms (6) and a drilling core (3) remains between the tool arms (6). As can be seen especially in FIG. 1, when the radially sweeping tool carriers (12) are swept inward, the roller boring tools (13) reach so far into the space between the tool arms (6) of the pilot borer, that the part of the drilling core that does not collapse of its own accord is broken up by the roller boring tools (13). The right-angle arrangement of the undercutting tools (12) to the tool arms (6) that form the pilot borer (2), and the distance of the tool arms (6) from each other, produce a continuous pilot boring with a simultaneous undercutting.

1 Boring head base body
2 Pilot borer
3 Drilling core
4 Ring-shaped cavity
5 Central axis
6 Tool arm
7 Boring Tool(s)
8 Tool holder
9 Support frame
10 Crossbeam
11 Forward-feed cylinder
12 Tool carrier(s)
13 Roller boring tool(s)
14 Turning axis
15 Side member(s)
16 Crossbrace
17 Boring site
18 Feed-piston gear unit(s)
19 Mounting support

We claim:

1. A tunneling machine for use in underground passages having a rotatively driven boring head base body comprising a fixed pilot borer and tool holders, and feed-piston gear members coupled to the boring head base body for sweeping at least one boring tool radially around an axis of rotation of said boring head base body between a working point in a pilot hole and gallery sides of said boring head base body, wherein said fixed pilot borer defines a ring borer that breaks out a drilling core through slits of an annular cavity; said fixed pilot borer comprising two parallel load-bearing tool arms spaced apart from a central axis; said at least one boring tool being coupled to said load-bearing tool arms, and wherein said load-bearing tool arms are coupled to a crossbeam of a support frame; said support frame comprising a forward feed mechanism wherein said support frame surrounds said feed-piston gear members, and wherein said support frame is perpendicular to radially sweeping tool carriers that are coupled to said boring head base body and wherein said support frame extends parallel to said central axis of said rotatively driven boring head base body.

2. Tunneling machine according to claim 1, wherein said support frame comprises side members slidably secured to said crossbeam therebetween such that said side members are longitudinally slidable, and wherein said forward feed mechanism comprises a pair of forward feed cylinders; said forward feed cylinders being integrated into said side members.

3. Tunneling machine according to claim 2, additionally comprising a least one cross brace secured to said side members.

4. Tunneling machine according to claim 1, wherein said boring tool coupled to said load-bearing tool arms comprise interchangeable roller boring tools.

5. Tunneling machine according to claim 1 wherein said at least one boring tool coupled to said load-bearing tool arms comprises flexibly coupled hardened steel chisels.

* * * * *